US010208497B1

(12) United States Patent
Warnes et al.

(10) Patent No.: US 10,208,497 B1
(45) Date of Patent: Feb. 19, 2019

(54) SUPPORT FOR A SIGNPOST

(71) Applicants: Mylan D. Warnes, Ogden, UT (US); Sue M. Warnes, Ogden, UT (US)

(72) Inventors: Mylan D. Warnes, Ogden, UT (US); Sue M. Warnes, Ogden, UT (US)

( * ) Notice: Subject to any disclaimer, the term of this patent is extended or adjusted under 35 U.S.C. 154(b) by 0 days.

(21) Appl. No.: 15/970,135

(22) Filed: May 3, 2018

(51) Int. Cl.
*E04H 12/20* (2006.01)
*E04H 12/22* (2006.01)
*G09F 7/18* (2006.01)

(52) U.S. Cl.
CPC ..... *E04H 12/2215* (2013.01); *E04H 12/20* (2013.01); *E04H 12/2292* (2013.01); *G09F 7/18* (2013.01); *G09F 2007/1856* (2013.01)

(58) Field of Classification Search
CPC . E04H 12/2215; E04H 12/2292; E04H 12/20; G09F 7/18; G09F 2007/1856; G09F 19/228; G09F 2007/1804; A45F 3/44
See application file for complete search history.

(56) References Cited

U.S. PATENT DOCUMENTS 672,625 A * 4/1901 Mullenix ..... E02D 5/80 256/48
775,759 A 11/1904 Meinecke
2,030,378 A 2/1936 Lippold
3,328,928 A * 7/1967 Frye ..... A63B 71/023 473/492
4,156,332 A 5/1979 Thompson
4,249,715 A * 2/1981 Repp ..... E01F 9/685 248/156
4,279,104 A 7/1981 Classen
4,326,352 A 4/1982 Barth
4,483,506 A 11/1984 Litwiller
4,530,190 A 7/1985 Goodman
4,756,128 A 7/1988 Danieli
4,803,812 A * 2/1989 Alexander, Sr. ..... E02D 5/801 52/157
4,939,877 A 7/1990 Claffey
5,123,623 A * 6/1992 McNamara ..... E04H 12/2253 248/156
5,372,457 A 12/1994 Rante
5,722,205 A * 3/1998 Gannaway ..... E04H 12/2215 52/153
6,725,872 B2 4/2004 Kindell
7,089,694 B2 8/2006 Allen
(Continued)

FOREIGN PATENT DOCUMENTS

CN 204225105 3/2015
DE 29723219 8/1998
(Continued)

*Primary Examiner* — Cassandra Davis
(74) *Attorney, Agent, or Firm* — Kunzler, PC; Bruce R. Needham

(57) ABSTRACT

A signpost support includes a vertical bar with a first end and a second end, and a ground anchor coupled to the vertical bar between the first end and the second end of the vertical bar. The ground anchor includes a body section coupled to the vertical bar, a spike extending from the body section, where the spike is oriented toward the second end of the vertical bar, a tab coupled to the body section and oriented perpendicular the vertical bar, and a spring section coupled to the body section and extending toward the first end of the vertical bar. The spring section is angled away from the vertical bar.

19 Claims, 8 Drawing Sheets

(56) References Cited

U.S. PATENT DOCUMENTS

| | | | | |
|---|---|---|---|---|
| 7,850,148 | B2 * | 12/2010 | Collins, IV | E04H 17/20 248/156 |
| 9,080,587 | B1 | 7/2015 | Smith | |
| 2001/0045068 | A1 | 11/2001 | Chalich | |
| 2011/0036026 | A1 | 2/2011 | Lee | |
| 2011/0308990 | A1 | 12/2011 | Pounders | |
| 2017/0193862 | A1 * | 7/2017 | Warnes | G09F 7/18 |

FOREIGN PATENT DOCUMENTS

| | | |
|---|---|---|
| FR | 2343877 | 10/1977 |
| GB | 365517 | 10/1930 |
| GB | 2250758 | 8/1991 |
| NL | 9000334 | 9/1991 |

* cited by examiner

SUPPORT FOR A SIGNPOST

FIELD

This invention relates to signposts and more particularly relates to a signpost support for a signpost.

BACKGROUND

Signposts and similar vertical rods are often used to support signs and other objects. Signposts are often placed in the ground of a yard or other property to advertise, to provide a warning, and the like. Often, a signpost bends or rotates due to wind, people pressing on the signpost, etc.

SUMMARY

A signpost support includes a vertical bar with a first end and a second end, and a ground anchor coupled to the vertical bar between the first end and the second end of the vertical bar. The ground anchor includes a body section coupled to the vertical bar, a spike extending from the body section, where the spike is oriented toward the second end of the vertical bar, a tab coupled to the body section and oriented perpendicular the vertical bar, and a spring section coupled to the body section and extending toward the first end of the vertical bar. The spring section is angled away from the vertical bar.

In some embodiments, the spring section includes a first end coupled to the body section and a second end distal to the first end, where the spring section exerts a spring force away from the vertical bar. In other embodiments, the spring section has a width perpendicular to the vertical bar, where the width spans an interior width of a side of a signpost positioned over the vertical bar and the spring section and prevents rotation of the signpost with respect to the signpost support.

In some embodiments, the vertical bar and spring section are sized to fit within an interior of a signpost slid over top of the vertical bar and the spring section. In other embodiments, the spring section has a first end coupled to the body section and a second end distal to the first end and the second end of the spring section extends away from the vertical bar a distance so that the vertical bar and second end of the spring section span an interior diameter of the signpost and the spring section applies a spring force against an interior of the signpost. In other embodiments, the second end of the spring section extends away from the vertical bar a distance greater than the interior diameter of the signpost, wherein pressing the spring section toward the vertical bar allows the vertical bar and spring section to be inserted into the signpost.

In some embodiments, the first end of the vertical bar extends beyond the spring section. In other embodiments, the vertical bar is a rod and the second end is tapered to a point. In other embodiments, the point of the vertical bar has a horizontal end, where the horizontal end is aligned with the spike. In other embodiments, the ground anchor includes a plate coupled to the vertical bar, where the plate includes the body section and one or more spikes and the ground anchor includes one or two tabs. Each tab includes a portion of the plate bent perpendicular to the vertical bar. In other embodiments, the spring section includes a portion of the plate and the body section of the plate is coupled to the vertical bar with the spring section angled away from the vertical bar.

In other embodiments, the spike extends away from the vertical bar with a point of the spike oriented parallel to the vertical bar in a direction toward the second end of the vertical bar. In other embodiments, the first end of the vertical bar includes tapered edges and a flat end, where the flat end is perpendicular to a direction from the first end to the second end of the vertical bar. In other embodiments, the tab extends a distance away from the vertical bar beyond an outside of a signpost placed over the first end of the vertical bar and the spring section. In other embodiments, the spring section includes a protrusion shaped to match one of a recess and a hold in a signpost that fits over the vertical bar and the spring section. In other embodiments, the spike includes a portion of a plate with a planar side and edges. The edges are perpendicular to the planar side, where the plate is shaped with a point on an edge of the spike and the point is oriented in a direction toward the second end of the vertical bar.

A signpost system includes a signpost with a hollow interior on a bottom end, a vertical bar with a first end and a second end, and a ground anchor coupled to the vertical bar between the first end and the second end of the vertical bar. The ground anchor includes a body section coupled to the vertical bar, a spike extending from the body section where the spike is oriented toward the second end of the vertical bar, a tab coupled to the body section and oriented perpendicular the vertical bar, and a spring section coupled to the body section and extending toward the first end of the vertical bar. The spring section is angled away from the vertical bar. When the hollow interior of the signpost is positioned over the first end of the vertical bar and the spring section and the vertical bar and spring section span an interior of the hollow interior.

In some embodiments, when a signpost is placed over the first end of the vertical bar and the spring section, the spring section exerts a spring force against an interior of the signpost and a width of the spring section is sized to prevent rotation of the signpost relative to the ground anchor, the signpost comprising at least one flat side. In other embodiments, the tab is a first tab and the spike is a first spike and the signpost system includes a second spike and a second tab. The first tab is coupled to the first spike and the second tab is coupled to the second spike. The second spike extends from the body section, and the second spike is oriented toward the second end of the vertical bar. The second tab is coupled to the body section and is oriented perpendicular to the vertical bar. The first and second tabs are oriented perpendicular to the first and second spikes and are located on opposite sides of the vertical bar.

Another embodiment of signpost support includes a vertical bar with a first end and a second end, where the second end has a point, a ground anchor coupled to the vertical bar between the first end and the second end of the vertical bar, where the ground anchor includes a plate. The plate includes a body section coupled to the vertical bar, a first spike, a second spike, a first tab coupled to the first spike, a second tab coupled to the second spike, and a spring section coupled to the body section. Each spike extends away from the body section in opposite directions. The first spike and second spike each are oriented parallel to the vertical bar towards the second end of the vertical bar. The first tab is oriented perpendicular to the first spike and the second tab is oriented perpendicular to the second spike. The first and second tabs are on opposite sides of the vertical bar. The second end of the vertical bar extends beyond the first and second spikes. The spring section extends toward the first end of the vertical bar and the first end of the vertical bar extends beyond the spring section. The spring section has a first end coupled to the body section and a second end distal to the first end of the spring section. The spring section is angled away from the vertical bar. When a signpost is placed over the first end of the vertical bar and the spring section, the spring section exerts a spring force against an interior of the signpost. A width of the spring section is sized to prevent rotation of the signpost relative to the ground anchor.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

Reference throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment, but mean "one or more but not all embodiments" unless expressly specified otherwise. The terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

Furthermore, the described features, structures, or characteristics of the invention may be combined in any suitable manner in one or more embodiments. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

Figure 1:
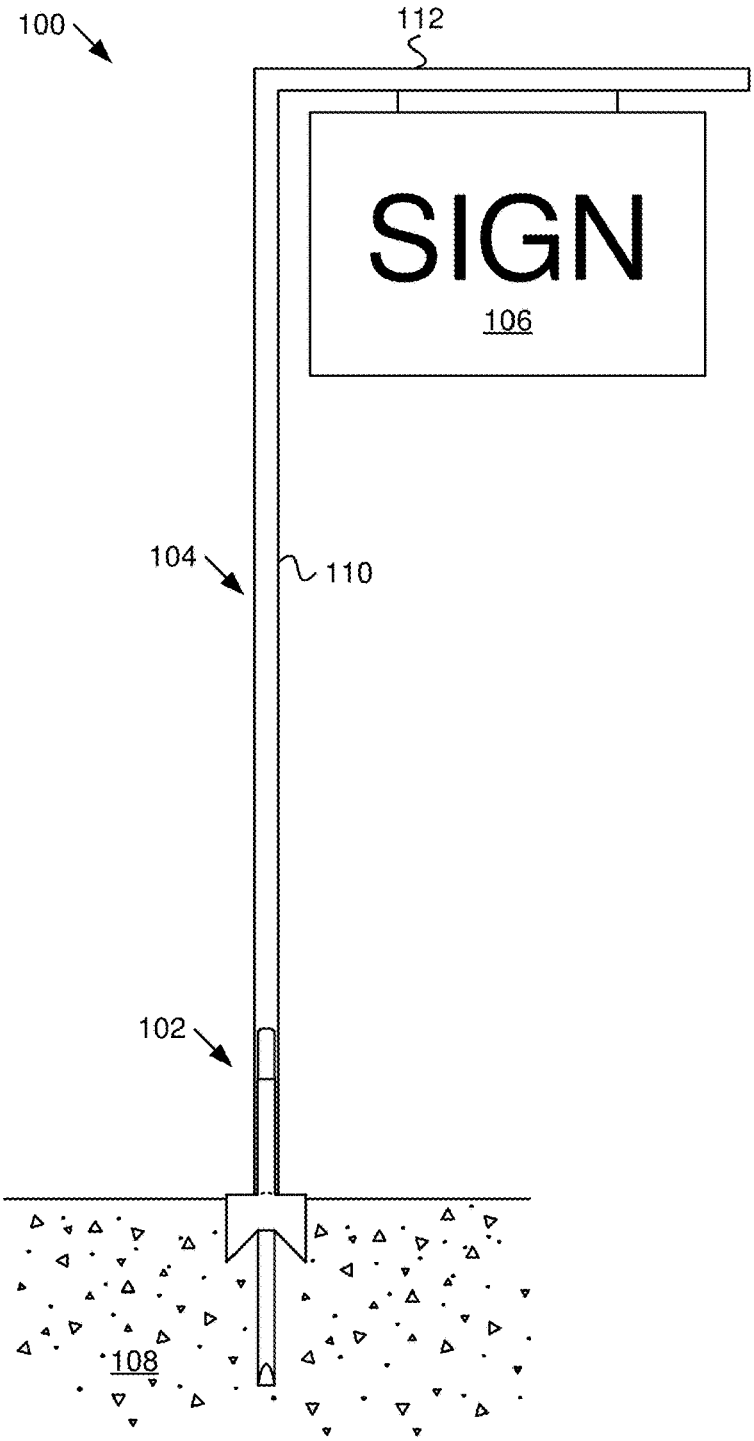
FIG. 1 is a front view illustrating one embodiment of a signpost support system with a signpost support and a signpost.

FIG. 1 is a front view illustrating one embodiment of a signpost support system 100 with a signpost support 102 and a signpost 104. The signpost support system 100 includes a signpost support 102, a signpost 104, and a sign 106, which are described below.

The signpost support 102 is placed in the ground 108 in dirt or other similar material, such as sand, gravel, grass, etc. and the signpost 104 is placed over the signpost support 102. In one embodiment, a sign 106 is connected to the signpost 104. The signpost 104 includes a hollow section at a bottom end of the signpost 104 and the signpost support 102 is sized to fit within the bottom, hollow portion of the signpost 104.

In one embodiment, the signpost 104 may be used for selling real estate, for advertising a business, or other similar use. In some embodiments, the signpost 104 includes a vertical section 110 and a horizontal section 112 where the vertical section supports the sign 106. In other embodiments, the signpost 104 includes a vertical section 110 and a sign 106 is attached to the vertical section 110. In other embodiments, the signpost 104 is curved, is zig-zag shaped, or other shape useful for displaying information. In other embodiments, the signpost 104 is used to support something other than a sign. For example, the signpost 104 may support a fence, a horizontal bar for hanging items, or some other purpose.

Figure 2:
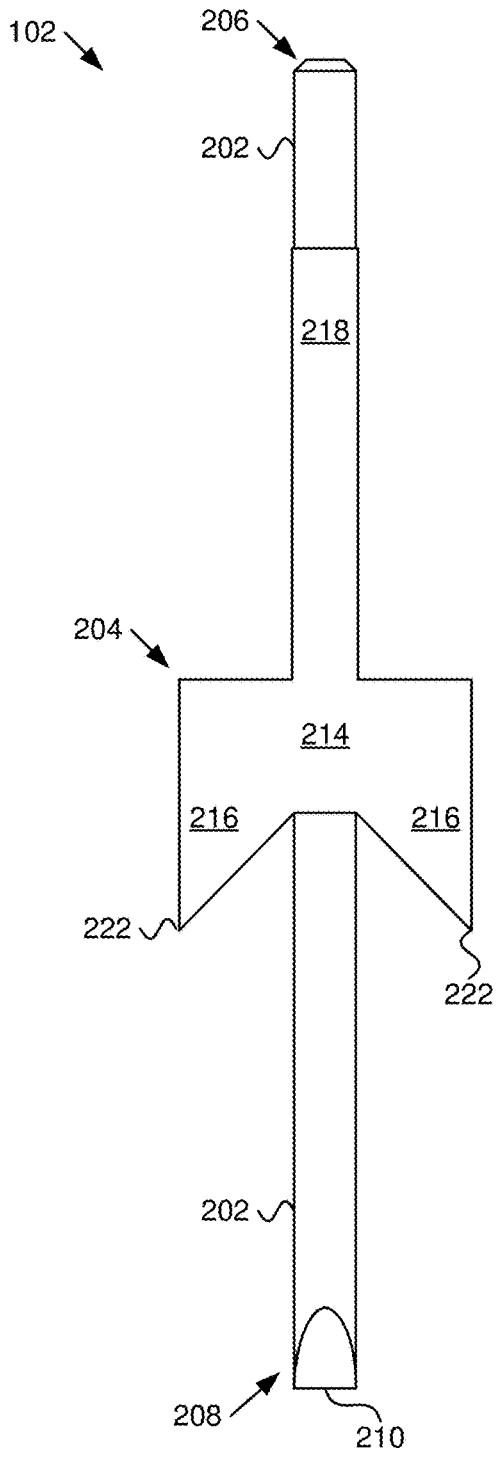
FIG. 2 is a front view further illustrating the signpost support of FIG. 1.
Figure 3:
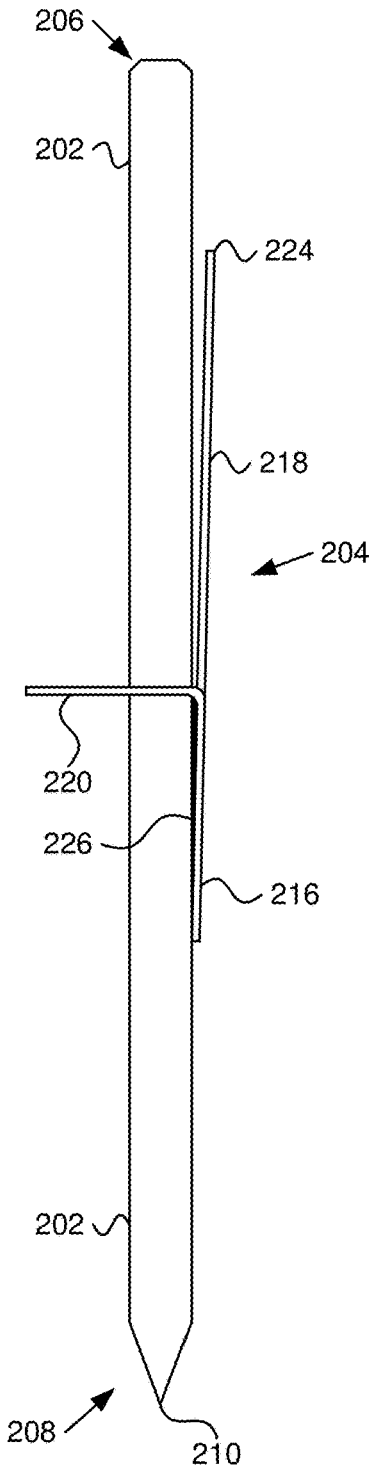
FIG. 3 is a left side view further illustrating the signpost support of FIG. 1.

FIG. 2 is a front view further illustrating the signpost support 102 of FIG. 1 and FIG. 3 is a left side view further illustrating the signpost support 102 of FIG. 1. The signpost support 102 includes a vertical bar 202 and a ground anchor 204 coupled to the vertical bar 202. In some embodiments, the vertical bar 202 is cylindrical. In other embodiments, vertical bar 202 has a cross section that is in another shape, such as a square, an oval, a triangle, an octagon, or the like. The vertical bar 202 includes a first end 206 and a second end 208. In some embodiments, the second end 208 is tapered to a point 210. In some cases, the point 210 of the vertical bar 202 includes a horizontal end. For example, the point 210 may be shaped with two opposite sides sloping to a sharp horizontal end in a knife-like or chisel-like shape.

In some embodiments, the first end 206 of the vertical bar 202 includes a beveled top, where the first end 206 of the vertical bar 202 has tapered edges and a flat top. The flat top is perpendicular to a direction from the first end 206 to the second end 208 of the vertical bar 202. The beveled top may facilitate pounding on the first end 206 of the vertical bar 202 with minimal flaring of the first end 206. For example, a typical cylindrical shaped metal bar may flair out when hit with a hammer. Having a beveled first end 206 of the vertical bar 202 may help reduce flaring beyond a diameter of the vertical bar 202.

The ground anchor 204 is coupled to the vertical bar 202 between the first end 206 and the second end 208 of the vertical bar 202. The ground anchor 204 includes, in some embodiments, a body section 214, a spike 216, a spring section 218, and a tab 220. The body section 214 is coupled to the vertical bar 202. For example, the body section 214 may be welded to the vertical bar 202. In other examples, the body section 214 may be bolted, riveted, wired, brazed, glued, etc. to the vertical bar 202. One of skill in the art will recognize other ways for the body section 214 of the ground anchor 204 to be connected to the vertical bar 202. While a body section 214 is described herein, the body section 214 is a matter of convenience and in other embodiments the ground anchor 204 may not include a body section 214 and instead one or more spikes 216 or tabs 220 maybe enlarged to cover the area marked as the body section 214.

The ground anchor 204 includes at least one spike 216 extending from the body section 214, where the spike 216 oriented toward the second end 208 of the vertical bar 202. For example, the spike 216 is pointed toward where the signpost support 102 is pounded in to the ground 108. The spike 216, in some embodiments, includes a pointed end 222 shaped to enter the ground 108 more easily than other shapes. In the example depicted in FIGS. 1, 2, 4 and 6, the ground anchor 204 of the signpost support 102 includes two spikes 216. In other examples, the ground anchor 204 may include a single spike 216, as depicted in FIG. 7B, or may include three or more spikes 216 (not shown). For example, the spikes 216 may be located at various angles around the vertical bar 202, such as at 120 degrees for three spikes 216, 90 degrees for four spikes 216, etc. The spikes 216 may be evenly spaced or may be spaced unevenly around the vertical bar 202.

In the ground anchor 204 of the signpost supports 102 of FIGS. 1, 2, 4 and 6, the spikes 216 have a pointed end 222 at a far end of the spike 216 distal to the vertical bar 202. In other embodiments, the pointed end 222 of the spike 216 may be located closer to the vertical bar 202. In some embodiments, the spike 216 may include a pointed end 222 centered or close to a center of the vertical bar 202 where the spike 216 extends horizontally away from the vertical bar 202 with a bottom edge angling upward. One of skill in the art will recognize other shapes that will facilitate being inserted into the ground 108.

In some embodiments, the one or more spikes 216 extend away from the vertical bar 202 to help prevent rotation of the vertical bar 202 while in the ground 108. For example, a spike 216 may be sized to extend away from the vertical bar 202 a distance to help prevent rotation of the signpost support 102 for anticipated rotational forces, such as wind on the signpost 104 and/or sign 106, people pushing against the signpost 104 and/or sign 106, etc. In other embodiments, the spike 216 maybe sized to extend away from the vertical bar 202 a distance equal to an amount that a tab 220 extends away from the vertical bar 202.

In other embodiments, the spike 216 does not include a pointed end, but instead has another shape on a bottom edge of the spike 216, where the bottom edge is oriented toward the second end 208 of the vertical bar 202. For example, the bottom edge of the spike 216 may be rounded with respect to a width of the spike 216 (e.g. in a direction extending from the vertical bar 202 to an outer, distal edge of the spike 216. In other embodiments, the spike 216 may have a straight bottom edge in a direction perpendicular to the vertical bar 202. In other embodiments, the bottom edge of the spike may be shaped to have point, similar to a knife edge. For example, the bottom edge of the spike 216 may be beveled to a sharp or rounded edge running along the bottom edge in direction away from the vertical bar 202. In one embodiment, the point 210 of the vertical bar 202 includes a horizontal end that is aligned with the one or more spikes 216 of the ground anchor 204.

The ground anchor 204, in some embodiments, includes one or more tabs 220 coupled to the body section 214 and/or spikes 216 of the ground anchor 204. In the embodiments depicted in FIGS. 4 and 7A, the ground anchor 204 includes two tabs 220. In some embodiments, the tabs 220 extend a distance away from the vertical bar 202 beyond an outside of the signpost 104 placed over the first end 206 of the vertical bar 202 and the spring section 218, which may prevent the signpost 104 from extending past the tabs 220. In other embodiments, the ground anchor 204 may include one tab 220, as depicted in the embodiment of FIG. 7B. The tabs 220 are sized, in some embodiments, to help keep the signpost support 102 from being inserted beyond the tabs 220 so that a portion of the signpost support 102 is maintained above the ground 108. In other embodiments, the tabs 220 are sized to allow a user to step on the tab 220 to facilitate insertion of the signpost support 102 into the ground 108. The tabs 220 in FIGS. 3, 5, 7A, 7B and 7C extend away from the spikes 216 a distance beyond a diameter of the vertical bar 202.

In other embodiments, the tabs 220 are shorter in the direction from the spikes 216 to an edge of the tabs 220 distal to the spikes 216. The size and shape of the tabs 220 may be changed for convenience, for cost savings, etc. While the tabs 220 are depicted attached to the spikes 216, in other embodiments, the tabs 220 are connected to the vertical bar 202, to the body section 214, etc. rather than being connected to the spikes 216.

In some embodiments, the ground anchor 204 is formed from a plate, such as a steel plate, an aluminum plate, etc. and the tabs 220 are bent away from a plane formed by the surface of the plate. Advantageously, using a plate may facilitate ease in manufacture in that a plate may be cut and then the tabs 220 bent to form the shape of the ground anchor 204. In other embodiments, the ground anchor 204 is milled or forged into a particular shape.

The ground anchor 204 is formed with a material or materials that are rigid enough to be coupled to the vertical bar 202 while maintaining a shape while the spikes 216 enter the ground 108 and the tabs 220 stop the signpost support 102 from being inserted past the tabs 220. The ground anchor 204 may be metal, may be a rigid plastic, fiberglass, a carbon composite material, may be made of wood, or other suitable rigid material or any combination thereof. One of skill in the art will recognize other rigid materials suitable for forming the ground anchor 204. Likewise, the vertical bar 202 may be metal, a carbon composite, a rigid plastic or other material suitable for insertion into the ground 108 while opposing forces on the signpost 104 while maintaining the signpost 104 in a vertical orientation.

The ground anchor 204 includes a spring section 218 coupled to the body section 214 of the ground anchor 204. The spring section 218 extends toward the first end 206 of the vertical bar 202 and, in some embodiments, is angled away from the vertical bar 202 as depicted in FIGS. 3-5, 7A, 7B and 7C. In some embodiments, the spring section 218 has a first end coupled to the body section 214 and a second end 224 distal to the first end, where the spring section 218 exerts a spring force away from the vertical bar 202.

The spring section 218, in some embodiments, extends away from the vertical bar 202 a distance so that placement of the signpost 104 over the signpost support 102 causes the vertical bar 202 and spring section 218 to span a diameter of the interior of the signpost 104. For example, a user may push the spring section 218 a distance toward the vertical bar 202 to fit the signpost 104 over the vertical bar 202 and spring section 218, which may then cause the spring section 218 and/or vertical bar 202 to exert a force against sides of the interior of the signpost 104.

In some embodiments, the ground anchor 204 is formed by a plate with tabs 220 bent away from the spring section 218 and the ground anchor 204 is then coupled to the vertical bar 202, such as with a weld 226, where the second end 224 of the spring section 218 is a particular distance from the vertical bar 202. For example, an exterior side of the spring section 218 that is away from the vertical bar 202 may be a distance from an opposite side of the vertical bar 202 that is the same as or just greater than a diameter of the interior of the signpost 104. Where the distance is greater, the spring section 218 may be bent toward the vertical bar 202 to accommodate the signpost 104.

In some embodiments, the spring section 214 has a width perpendicular to the vertical bar 202, where the width spans an interior width of a side of the signpost 104 positioned over the vertical bar 202 and the spring section 218 and prevents rotation of the signpost 104 with respect to the signpost support 102. For example, the signpost 104 may have a straight side which may be placed against the spring section 218 and the width of the spring section 218 may be sized to prevent rotation of the signpost 104 relative to the signpost support 102. The width of the spring section 218 maybe a same width as the side of the interior of the signpost 104, may be just shorter than the width of the side of the interior of the signpost 104, etc.

One of skill in the art will recognize how to size the width of the spring section 218 to substantially prevent rotation of the signpost 104 with respect to the signpost support 102. Substantially preventing rotation of the signpost with respect to the signpost support 102 means that the signpost 104 may rotate slightly, but is prevented from rotating beyond a few degrees, such as 15 degrees or less. For example, the signpost 104 may rotate with respect to the signpost support 102 a small amount, but is prevented from rotating more than a specified amount, such as 20 degrees.

In some embodiments, the first end 206 of the vertical bar 202 extends beyond the second end 224 of the spring section 218, as depicted in FIGS. 2-6. For example, where the first end 206 of the vertical bar 202 extends beyond the second end 224 of the spring section 218, hammering on the vertical bar 202 may avoid hitting the spring section 218. In some embodiments, the first end 206 of the vertical bar 202 extends beyond the second end 224 of the spring section 218 a distance greater than a width of a hand of a user so the user can hold the portion of the vertical bar 202 above the spring section 218 with a portion extending above the hand of the user so the user may avoid being hit with a hammer pounding on the top of the vertical bar 202. In other embodiments, the second end 224 of the spring section 218 is close to or level with the first end 206 of the vertical bar 202.

In some embodiments, the second end 208 of the vertical bar 202 extends beyond the spikes 216 of the ground anchor 204. For example, a length of the vertical bar 202 below the tabs 220 may be sized to support a size of the signpost 104 and assumed forces on the signpost 104 where the spikes 216 may be sized to prevent rotation of the signpost support 102 in the ground 108, which may result in the second end 208 of the vertical bar 202 extending beyond the spikes 216 of the ground anchor 204. In another embodiment, second end 208 of the vertical bar 202 is even with or nearly even with the pointed end 222 of the spikes 216 of the ground anchor 204.

Figure 4:
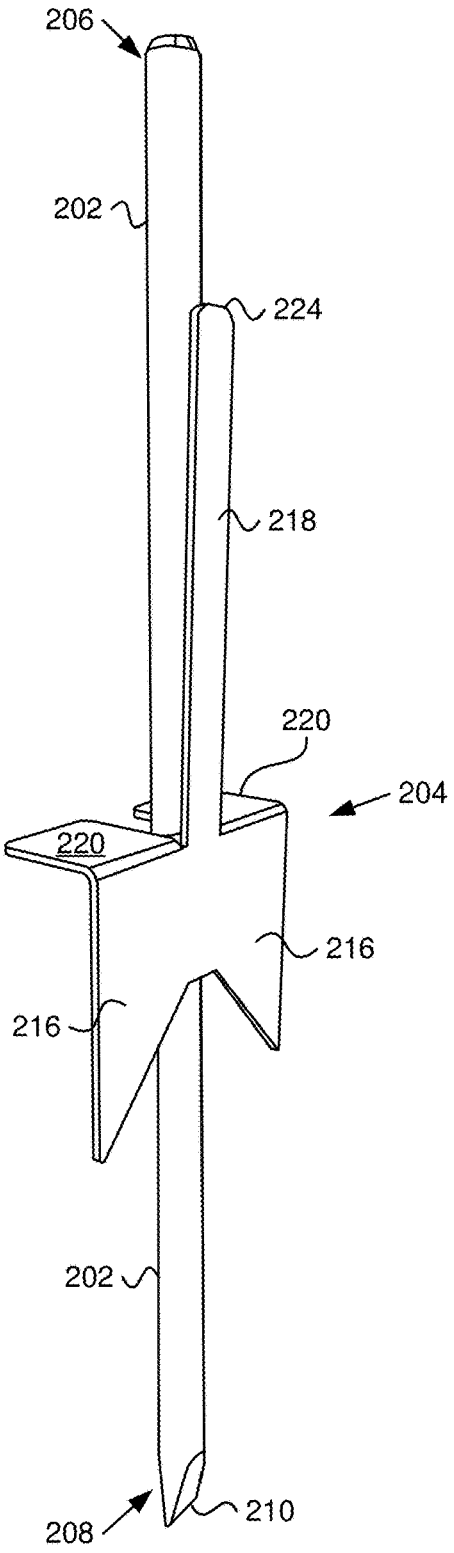
FIG. 4 is a perspective view further illustrating the signpost support of FIG. 1.
Figure 5:
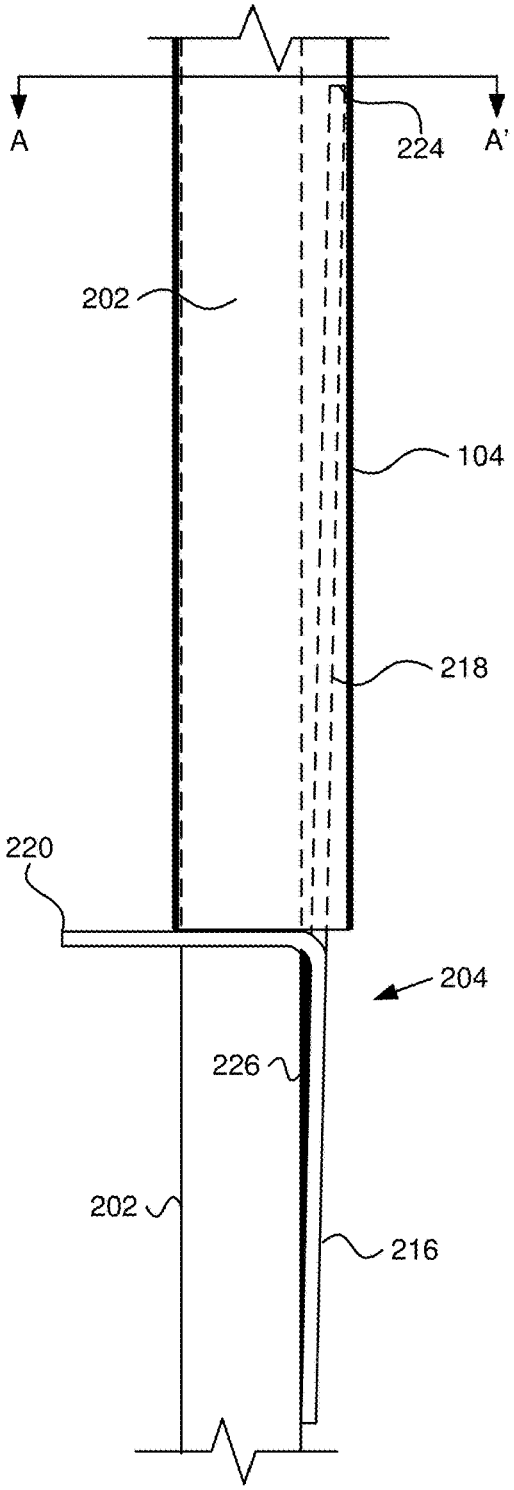
FIG. 5 is an enlarged left side view of the signpost support depicted in FIG. 3 depicting a signpost over a top portion of the signpost support.
Figure 6:
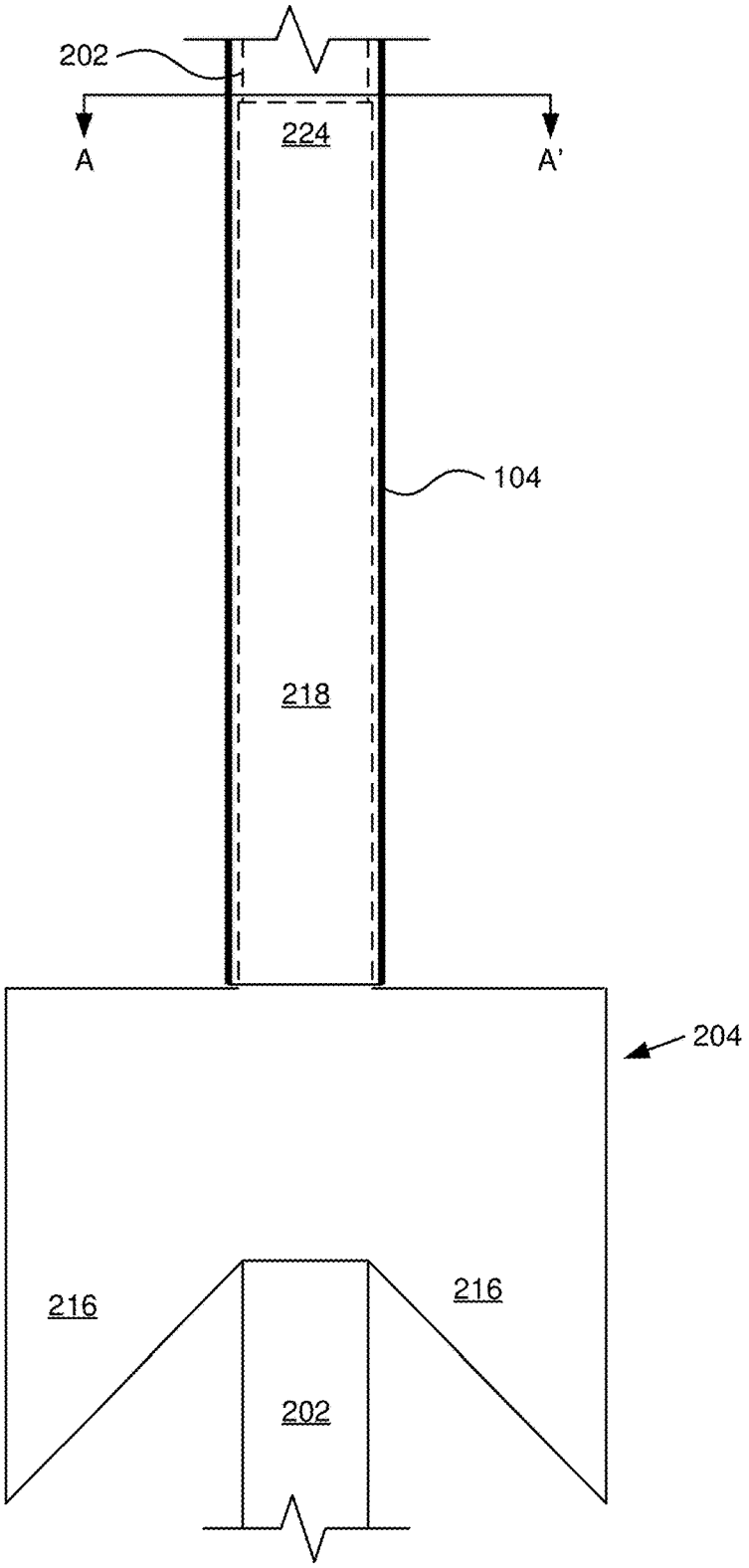
FIG. 6 is an enlarged left side view of the signpost support depicted in FIG. 4 depicting a signpost over a top portion of the signpost support.

FIG. 5 is an enlarged left side view of the signpost support 102 depicted in FIG. 3 depicting a signpost 104 over a top portion of the signpost support 102 and FIG. 6 is an enlarged left side view of the signpost support 102 depicted in FIG. 4 depicting a signpost 104 over a top portion of the signpost support 102. The vertical bar 202 and spring section 218 are depicted as dashed. The signpost 104 stops at the tabs 220. In addition, as depicted in FIG. 5, the vertical bar 202 and spring section 218 span the interior of the signpost 104 to prevent movement and rotation of the signpost 104 with respect to the signpost support 102. In the embodiment depicted in FIG. 6, the width of the spring section 218 spans a side of the signpost 104, which also helps to prevent rotation of the signpost 104 with respect to the signpost support 102.

Figure 7A:
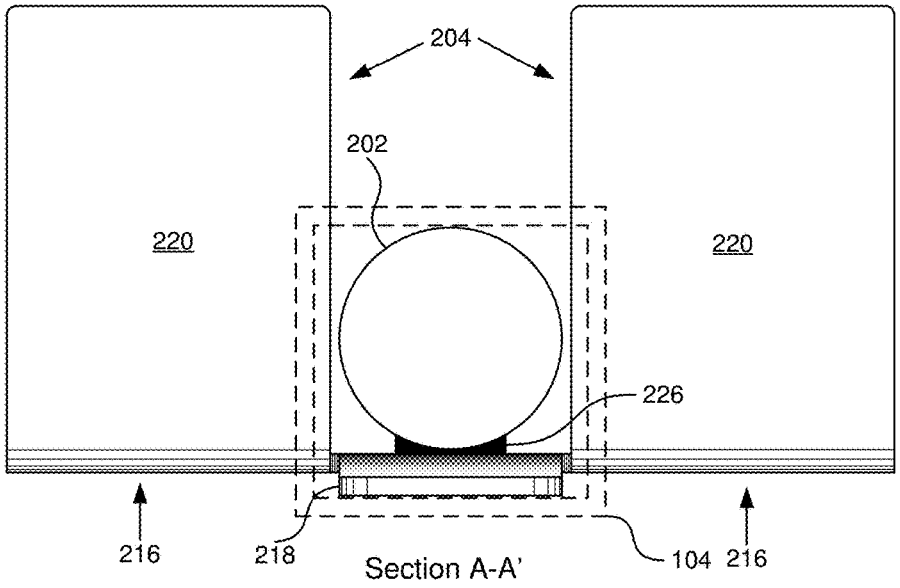
FIG. 7A is a section view A-A' of the signpost support and signpost of FIGS. 5 and 6.
Figure 7B:
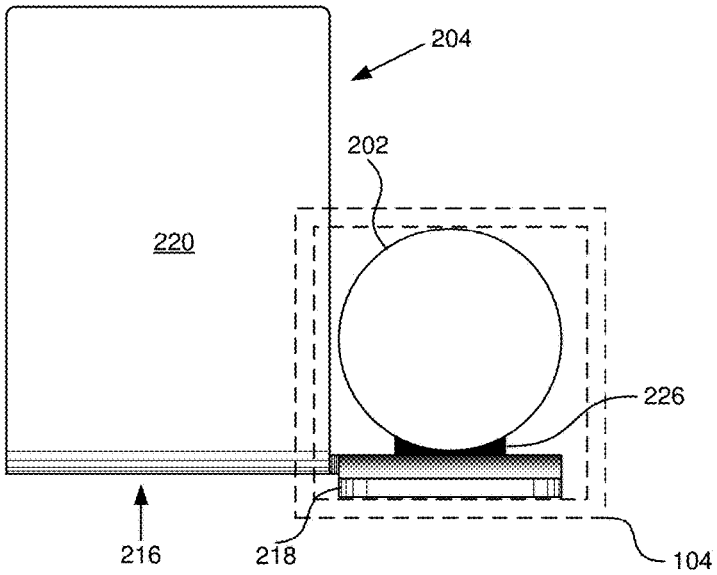
FIG. 7B is a section view A-A' of the signpost support and signpost of FIGS. 5 and 6 with an embodiment of the signpost support with a single tab.

FIG. 7A is a section view A-A' of the signpost support 102 and signpost 104 of FIGS. 5 and 6. The embodiment includes two tabs 220 and spikes 216. In the embodiment, the signpost 104 (depicted as a dashed line) is square and extends beyond a width of the spring section 218. While the signpost 104 may rotate a small amount, the signpost 104 is substantially prevented from rotating with respect to the signpost support 102. In another embodiment, the spring section 218 is wider than the vertical bar 202 and spans a side of the interior of the signpost 104. FIG. 7B is a section view A-A' of the signpost support 102 and signpost 104 of FIGS. 5 and 6, but with an embodiment of the signpost support 102 with a single tab 216, as described above. A single spike 216 and tab 220 may server to prevent rotation of the signpost support 102 in the ground 108 and stopping the signpost support 102 from being inserted into the ground 108 beyond the tab 220.

Figure 7C:
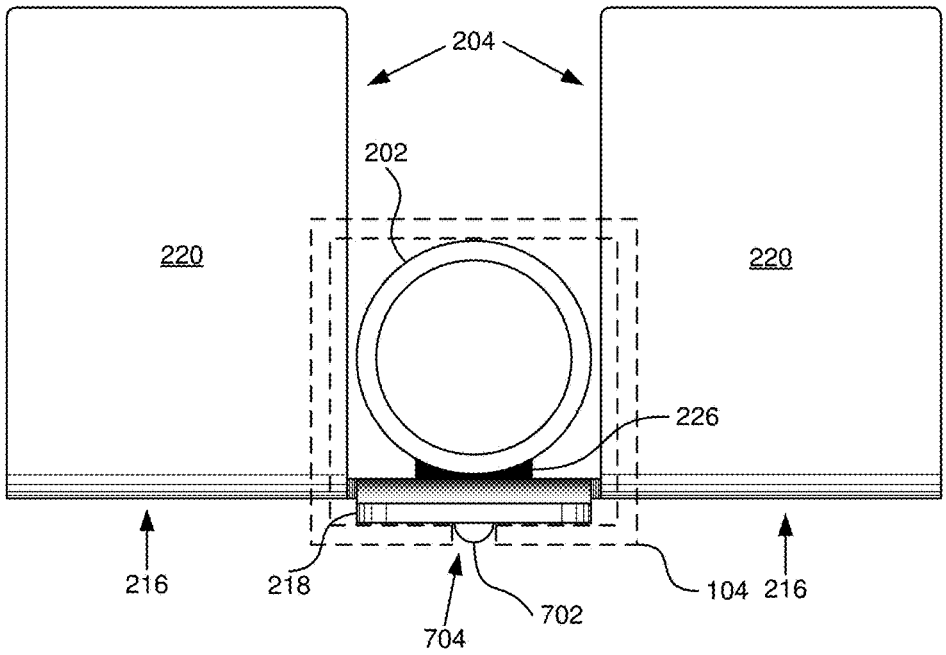
FIG. 7C is a section view A-A' of the signpost support and signpost of FIGS. 5 and 6 with an embodiment of the signpost support with a protrusion on a spring section and a corresponding recess in the signpost.

FIG. 7C is a section view A-A' of the signpost support 102 and signpost 104 of FIGS. 5 and 6 with an embodiment of the signpost support 102 with a protrusion 702 on the spring section 218 and a corresponding recess 704 in the signpost 104. In the depicted embodiment, the recess 704 extends through the signpost 104. In another embodiment, the recess 704 in the signpost 104 does not extend through the signpost 104. The protrusion 702 and recess 704 may help to prevent the signpost 104 from being pulled off of the signpost support 102.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A signpost support comprising:

a vertical bar comprising a first end and a second end;

a ground anchor coupled to the vertical bar between the first end and the second end of the vertical bar, the ground anchor comprising a body section coupled to the vertical bar;

a spike extending from the body section, the spike oriented toward the second end of the vertical bar;

a tab coupled to the body section and oriented perpendicular the vertical bar; and a spring section coupled to the body section and extending toward the first end of the vertical bar, the spring section angled away from the vertical bar.

2. The signpost support of claim 1, wherein the spring section comprises a first end coupled to the body section and a second end distal to the first end, wherein the spring section exerts a spring force away from the vertical bar.

3. The signpost support of claim 1, wherein the spring section comprises a width perpendicular to the vertical bar, wherein the width span is adapted to an interior width of a side of a signpost positioned over the vertical bar and the spring section and prevents rotation of the signpost with respect to the signpost support.

4. The signpost support of claim 1, wherein the vertical bar and spring section are sized to fit within an interior of a signpost slid over top of the vertical bar and the spring section.

5. The signpost support of claim 4, wherein the spring section comprises a first end coupled to the body section and a second end distal to the first end and wherein the second end of the spring section extends away from the vertical bar a distance so that the vertical bar and second end of the spring is adapted to section span an interior diameter of the signpost and the spring section applies a spring force against an interior of the signpost.

6. The signpost support of claim 5, wherein the second end of the spring section is adapted to extends away from the vertical bar a distance greater than the interior diameter of the signpost, wherein pressing the spring section toward the vertical bar allows the vertical bar and spring section to be inserted into the signpost.

7. The signpost support of claim 1, wherein the first end of the vertical bar extends beyond the spring section.

8. The signpost support of claim 1, wherein the vertical bar comprises a rod and the second end is tapered to a point.

9. The signpost support of claim 1, wherein the ground anchor comprises a plate coupled to the vertical bar, wherein the plate comprises the body section and one or more said spikes and wherein the ground anchor comprises one or two said tabs, each tab comprising a portion of the plate bent perpendicular to the vertical bar.

10. The signpost support of claim 9, wherein the spring section comprises a portion of the plate and the body section of the plate is coupled to the vertical bar with the spring section angled away from the vertical bar.

11. The signpost support of claim 1, wherein the spike extends away from the vertical bar with a point of the spike oriented parallel to the vertical bar in a direction toward the second end of the vertical bar.

12. The signpost support of claim 1, wherein the first end of the vertical bar comprises tapered edges and a flat end, the flat end perpendicular to a direction from the first end to the second end of the vertical bar.

13. The signpost support of claim 1, wherein the tab is adapted to extends a distance away from the vertical bar beyond an outside of a signpost placed over the first end of the vertical bar and the spring section.

14. The signpost support of claim 1, wherein the spring section comprises a protrusion shaped to match one of a recess and a hold in a signpost that fits over the vertical bar and the spring section.

15. The signpost support of claim 1, wherein the spike comprises a portion of a plate with a planar side and edges, the edges perpendicular to the planar side, wherein the plate is shaped with a point on an edge of the spike, the point oriented in a direction toward the second end of the vertical bar.

16. A signpost system comprising:

a signpost comprising a hollow interior on a bottom end;

a vertical bar comprising a first end and a second end; and a ground anchor coupled to the vertical bar between the first end and the second end of the vertical bar, the ground anchor comprising a body section coupled to the vertical bar;

a spike extending from the body section, the spike oriented toward the second end of the vertical bar;

a tab coupled to the body section and oriented perpendicular the vertical bar; and a spring section coupled to the body section and extending toward the first end of the vertical bar, the spring section angled away from the vertical bar, wherein when the hollow interior of the signpost is positioned over the first end of the vertical bar and the spring section and the vertical bar and spring section span an interior of the hollow interior.

17. The signpost system of claim 16, wherein when a signpost is placed over the first end of the vertical bar and the spring section, the spring section exerts a spring force against an interior of the signpost and wherein a width of the spring section is sized to prevent rotation of the signpost relative to the ground anchor, the signpost comprising at least one flat side.

18. The signpost system of claim 16, wherein the tab comprises a first tab and the spike comprises a first spike and further comprising a second spike and a second tab, wherein the first tab is coupled to the first spike and the second tab is coupled to the second spike, the second spike extending from the body section, the second spike oriented toward the second end of the vertical bar, the second tab coupled to the body section and oriented perpendicular to the vertical bar, the first and second tabs oriented perpendicular to the first and second spikes and are located on opposite sides of the vertical bar.

19. A signpost support comprising:

a vertical bar comprising a first end and a second end, the second end comprising a point;

a ground anchor coupled to the vertical bar between the first end and the second end of the vertical bar, the ground anchor comprising a plate, the plate comprising a body section coupled to the vertical bar;

a first spike and a second spike, each spike extending away from the body section in opposite directions, the first spike and second spike each oriented parallel to the vertical bar towards the second end of the vertical bar;

a first tab coupled to the first spike and a second tab coupled to the second spike, the first tab oriented perpendicular to the first spike, the second tab oriented perpendicular to the second spike, the first and second tabs on opposite sides of the vertical bar, wherein the second end of the vertical bar extends beyond the first and second spikes; and a spring section coupled to the body section and extending toward the first end of the vertical bar, the first end of the vertical bar extending beyond the spring section, the spring section comprising a first end coupled to the body section and a second end distal to the first end of the spring section, the spring section angled away from the vertical bar, wherein when a signpost is placed over the first end of the vertical bar and the spring section, the spring section exerts a spring force against an interior of the signpost, and wherein a width of the spring section is sized to prevent rotation of the signpost relative to the ground anchor.

* * * * *